US009233694B2

(12) United States Patent
Kato et al.

(10) Patent No.: US 9,233,694 B2
(45) Date of Patent: Jan. 12, 2016

(54) RAILCAR INCLUDING HEAT-RESISTANT FLOOR

(75) Inventors: Eiichi Kato, Souraku-gun (JP); Chihiro Okayama, Kakogawa (JP); Seiichi Hayashi, Kobe (JP); Osamu Muragishi, Kakogawa (JP); Yuji Kamei, Himeji (JP); Shuichi Mizuma, Kakogawa (JP)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 145 days.

(21) Appl. No.: 14/006,821

(22) PCT Filed: Mar. 23, 2011

(86) PCT No.: PCT/JP2011/001707

§ 371 (c)(1),
(2), (4) Date: Dec. 9, 2013

(87) PCT Pub. No.: WO2012/127533

PCT Pub. Date: Sep. 27, 2012

(65) Prior Publication Data

US 2014/0083321 A1 Mar. 27, 2014

(51) Int. Cl.
*B61D 17/10* (2006.01)
*B61D 17/00* (2006.01)

(52) U.S. Cl.
CPC ..... *B61D 17/00* (2013.01); *B61D 17/10* (2013.01)

(58) Field of Classification Search
CPC ..... B61D 17/00; B61D 17/04; B61D 17/10
USPC ..... 105/396, 397, 404, 413–415, 419, 420, 105/422
See application file for complete search history.

(56) References Cited

U.S. PATENT DOCUMENTS 4,794,032 A * 12/1988 Fujii et al. ..... 428/209
6,910,428 B2 * 6/2005 Laflamme et al. ..... 105/413

FOREIGN PATENT DOCUMENTS

| | | | |
|---|---|---|---|
| DE | 3415848 | A1 | 10/1985 |
| EP | 0241116 | A1 | 10/1987 |
| EP | 0392828 | A2 | 10/1990 |
| EP | 1832491 | A2 | 9/2007 |
| JP | S59-131359 | U | 9/1984 |
| JP | S61-147666 | U | 9/1986 |
| JP | A-62-189251 | | 8/1987 |
| JP | H04-90454 | U | 8/1992 |

(Continued)

OTHER PUBLICATIONS

Office Action issued in Japanese Application No. 2013-505617 dated Sep. 2, 2014 (with translation).

(Continued)

*Primary Examiner* — R. J. McCarry, Jr.
(74) *Attorney, Agent, or Firm* — Oliff PLC

(57) ABSTRACT

A railcar includes a heat-resistant floor, and the heat-resistant floor includes a floor panel, a heat absorbing layer provided under the floor panel and configured to absorb heat, and a supporting plate configured to support the heat absorbing layer from below. The supporting plate includes contacting portions each configured to contact the heat absorbing layer and separated portions each continuously formed from the contacting portion in a railcar width direction, separated downward from the heat absorbing layer, and extending in a railcar longitudinal direction.

9 Claims, 4 Drawing Sheets

(56) References Cited

FOREIGN PATENT DOCUMENTS

| | | |
|---|---|---|
| JP | A-7-54431 | 2/1995 |
| JP | A-11-050565 | 2/1999 |
| JP | A-2000-52982 | 2/2000 |
| JP | A-2002-173995 | 6/2002 |
| JP | A-2009-196531 | 9/2009 |

OTHER PUBLICATIONS

Jan. 9, 2015 Extended European Search Report issued in European Application No. 11861523.6.

International Search Report issued in International Patent Application No. PCT/JP2011/001707 mailed Jun. 14, 2011.

International Preliminary Report on Patentability issued in International Patent Application No. PCT/JP2011/001707 mailed Dec. 14, 2012 (with translation).

* cited by examiner

RAILCAR INCLUDING HEAT-RESISTANT FLOOR

TECHNICAL FIELD

The present invention relates to a railcar, and particularly to a railcar including a heat-resistant floor.

BACKGROUND ART

In consideration of fire under a floor of a railcar, the floor is required to have predetermined heat resistance (fire resistance) in some cases. One example of a fire resistant standard is an American fire resistant standard "ASTM (American Standard Test Method) E-119". In the ASTM E-119, some provisions are made, and one example is that even if heat is continuously applied to a lower surface of a test body (floor) for a predetermined period of time, an increase in temperature on an upper surface of the test body is equal to or smaller than a certain value. A floor structure of a railcar produced in consideration of the above standard is proposed in, for example, PTL 1. To be specific, the floor structure described in PTL 1 is constituted by an upper layer, a middle layer, and a lower layer, and a heat insulating material layer is provided between the lower layer and the middle layer. According to the floor structure, since the heat insulating material layer is provided, a heat insulating effect of the floor can be improved (see PTL 1, page 2, lower left column, line 6 and subsequent lines).

Normally, the heat resistance can be improved by increasing the thickness of the heat insulating layer. However, if the thickness of the heat insulating layer is increased too much, a space under the floor narrows, so that the space for arranging cables and devices under the floor may not be secured. Here, PTL 2 proposes a floor structure of a linear motor car configured for the purpose of obtaining the same fire-resistant function as a conventional floor structure without reducing an installation space for devices and the like arranged under the floor. In this floor structure, a plate-shaped expansion-type heat insulating material is arranged so as to cover a lower surface of a floor panel and also cover respective surfaces of a side sill, a cross beam, and a center sill (see PTL 2, FIG. 4, for example). PTL 2 explains that: the expansion-type heat insulating material expands by the heat of a flame to form a heat insulating layer, so that the increase in temperature on the upper surface of the floor panel can be suppressed; and since the expansion-type heat insulating material is thinner than a conventional plate-shaped heat insulating material, the installation space for cables and the like is not reduced (see PTL 2, paragraph 0016).

CITATION LIST

Patent Literature

PTL 1: Japanese Laid-Open Patent Application Publication No. 62-189251

PTL 2: Japanese Laid-Open Patent Application Publication No. 2009-196531

SUMMARY OF INVENTION

Technical Problem

The floor structure of PTL 1 can improve the heat insulating effect of the floor. However, there are problems that: the floor structure is complex; and a railcar that adopts this floor structure increases in weight. Further, another problem is that since the floor increases in thickness by adopting this floor structure, the installation space for cables and the like under the floor is reduced.

The floor structure of PTL 2 can suppress the reduction in the installation space for cables and the like. However, there is a problem that an adequate heat resistance performance cannot be obtained. To be specific, a main purpose of the expansion-type heat insulating material used in PTL 2 is to expand to form the heat insulating layer. Therefore, a heat absorption amount of the expansion-type heat insulating material is comparatively small, and the expansion-type heat insulating material starts expanding from a comparatively low temperature, such as 100 to 150° C., and quickly finishes expanding. Therefore, there is a problem that according to the floor structure of PTL 2, the expansion-type heat insulating material cannot adequately absorb heat in the process of a gradual temperature increase, so that the adequate heat resistance performance cannot be obtained.

Here, an object of the present invention is to provide a railcar including a heat-resistant floor having a simple configuration and high heat resistance.

Solution to Problem

A railcar according to an aspect of the present invention includes a heat-resistant floor, and the heat-resistant floor includes: a floor panel; a heat absorbing layer provided under the floor panel and configured to absorb heat; and a supporting plate configured to support the heat absorbing layer from below, wherein the supporting plate includes: contacting portions each configured to contact the heat absorbing layer; and separated portions each continuously formed from the contacting portion in a railcar width direction, separated downward from the heat absorbing layer, and extending in a railcar longitudinal direction. According to this configuration, when heat is applied to the lower surface of the heat-resistant floor, portions, contacting the supporting plate, of the heat absorbing layer start absorbing heat at a comparatively early stage, and portions, separated from the supporting plate, of the heat absorbing layer start absorbing heat at a comparatively later stage. As above, a heat absorption start time is caused to differ among respective portions of the heat absorbing layer. With this, the heat absorbing layer as a whole can continuously absorb the heat for a long period of time.

Advantageous Effects of Invention

The present invention can provide a railcar including a heat-resistant floor having a simple configuration and high heat resistance.

DESCRIPTION OF EMBODIMENTS

Hereinafter, embodiments of a heat-resistant floor of a railcar according to the present invention will be explained in reference to the drawings. In the following explanations and drawings, the same reference signs are used for the same or corresponding components, and a repetition of the same explanation is avoided.

Embodiment 1

Figure 1:
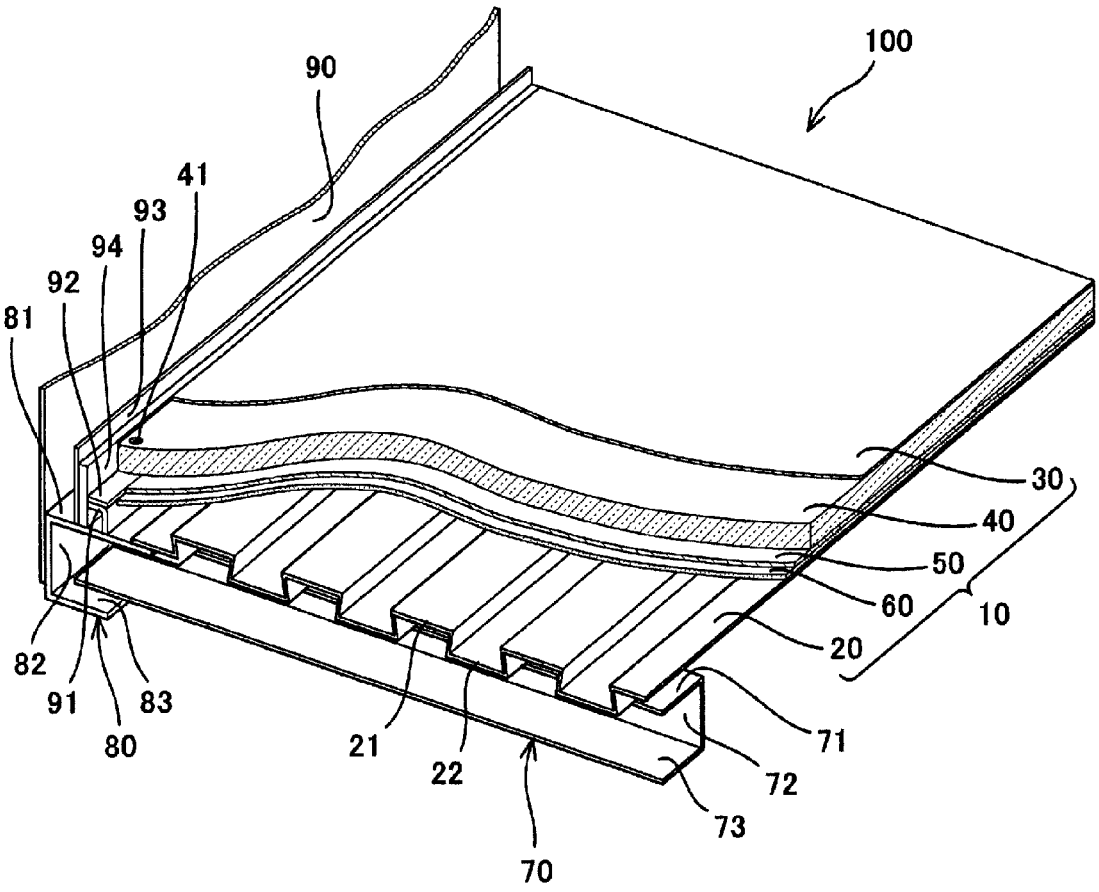
FIG. 1 is a cross-sectional perspective view of a heat-resistant floor according to Embodiment 1 of the present invention.

First, a railcar 100 according to Embodiment 1 of the present invention will be explained in reference to FIGS. 1 to 4. FIG. 1 is a cross-sectional perspective view of a heat-resistant floor 10 included in the railcar 100 according to the present embodiment. In FIG. 1, a direction from a near side (side where the cross section is shown) on the sheet toward a far side on the sheet corresponds to a longitudinal direction of the railcar 100. In the following explanation, the longitudinal direction of the railcar 100 is simply referred to as a "longitudinal direction", and a width direction of the railcar 100 is simply referred to as a "width direction". As shown in FIG. 1, the railcar 100 according to the present embodiment includes the heat-resistant floor 10.

Configuration of Heat-resistant Floor

First, the configuration of the heat-resistant floor 10 according to the present embodiment will be explained in referent to FIG. 1. As shown in FIG. 1, the heat-resistant floor 10 is a member constituting a floor surface of the railcar 100. The heat-resistant floor 10 is supported by a cross beam 70 and fixed to a side sill 80. The heat-resistant floor 10 includes a supporting plate 20, a surface sheet 30, a floor panel 40, a heat dispersing layer 50, and a heat absorbing layer 60. Hereinafter, these components will be explained in order.

The supporting plate 20 is a member configured to support the heat absorbing layer 60 from below. The supporting plate 20 is made of metal, such as stainless steel. As shown in FIG. 1, the supporting plate 20 includes: contacting portions 21 contacting the heat absorbing layer 60; and separated portions 22 separated downward from the heat absorbing layer 60. Each contacting portion 21 is formed in a flat plate shape and extends in the longitudinal direction. The contacting portions 21 are flush with one another. Each separated portion 22 is formed to have a U-shaped cross section and extends in the longitudinal direction. The contacting portions 21 and the separated portions 22 are alternately, continuously arranged in the width direction. Therefore, the entire supporting plate 20 is formed in a wave shape. To be specific, the supporting plate 20 has a so-called "corrugated structure". More specifically, for example, in a cross-sectional view, the supporting plate 20 is formed so as to increase in width as it extends downward. To be specific, the supporting plate 20 has a so-called "keystone structure". Since the supporting plate 20 has the keystone structure, the separated portions 22 serve as beams (reinforcing members). Therefore, the strength of the supporting plate 20 can be improved, and therefore, the strength of the heat-resistant floor 10 can be improved.

Among respective members stacked in the heat-resistant floor 10, the surface sheet 30 is a member located at an uppermost surface side. The surface sheet 30 is, for example, a rubber sheet and can cushion the impact generated when, for example, a passenger walks and applied to the heat-resistant floor 10. In addition, the surface sheet 30 can substantially prevent noises, emitted from devices arranged under the floor, from being transmitted to a passenger room side. Further, as described below, a screw 41 is attached to the floor panel 40. The surface sheet 30 can prevent depressions and projections, generated on the floor panel 40 by the screw 41, from appearing on a surface of the heat-resistant floor 10. The surface sheet 30 is not limited to the rubber sheet. Instead of this, a floor material, such as a vinyl chloride resin sheet, an olefin resin sheet, or a carpet, typically used in railcars can be used as the surface sheet 30.

The floor panel 40 is a member configured to secure the stiffness of the heat-resistant floor 10 and is a so-caller "base material". The floor panel 40 according to the present embodiment is made of a foam material of synthetic resin. The floor panel 40 is located under the surface sheet 30 and is the thickest among the respective members stacked in the heat-resistant floor 10. The material of the floor panel 40 is not limited to the foam material of synthetic resin. Instead of this, a known material, such as wood or a light alloy honeycomb material, used for the floor panel may be used as the material of the floor panel 40.

The heat dispersing layer 50 is a layer configured to disperse heat in a surface direction. As shown in FIG. 1, the heat dispersing layer 50 is located between the floor panel 40 and the heat absorbing layer 60. The heat dispersing layer 50 is made of a heat insulating material. The heat insulating material of the heat dispersing layer 50 is not especially limited, and glass wool, ceramic wool, or the like may be used. Since the heat dispersing layer 50 is made of the heat insulating material as above, the heat dispersing layer 50 has not only the effect of dispersing heat but also the heat insulating effect. A difference between a "heat absorbing material" contained in the below-described heat absorbing layer 60 and the "heat insulating material" of the heat dispersing layer 50 will be simply explained. The heat absorbing material and the heat insulating material are different from each other in that the heat absorbing material is a material that performs an endothermic reaction of absorbing heat whereas the heat insulating material does not absorb heat and is just a material to which heat is less likely to be transferred.

The heat absorbing layer 60 is a layer configured to absorb heat. As shown in FIG. 1, the heat absorbing layer 60 is supported by the supporting plate 20. The heat absorbing layer 60 is formed by scattering the heat absorbing material in the ceramic wool. In the present embodiment, vermiculite that is a heat expansion material is used as the heat absorbing material. The entire heat absorbing layer 60 according to the present embodiment expands as the heat absorbing material (vermiculite) expands by heat. The heat absorbing material used in the heat absorbing layer 60 may be a member other than the vermiculite, and it is desirable that a heat absorption start temperature of the heat absorbing material be 350 to 550° C. This is because if the heat absorbing material starts absorbing heat at a low temperature, the function of the heat absorbing material cannot be adequately achieved. For example, a heat-resistant and heat-insulating material M20A produced by Sumitomo 3M Ltd. may be used as the heat absorbing layer 60.

In the present embodiment, the area of portions, contacting the supporting plate 20, of the heat absorbing layer 60 is set to be at least about 20% of the entire area of the heat absorbing layer 60. It should be noted that the percentage of the area of the portions, contacting the supporting plate 20, of the heat absorbing layer 60 may be changed depending on, for example, the characteristics of the heat absorbing material constituting the heat absorbing layer 60. For example, the percentage may be set to about 50%, that is, the percentage of the area of portions where heat is quickly transferred and the percentage of the area of portions where heat is slowly transferred may be set to be the same as each other. Further, each of closed spaces that are hollow is formed between the heat absorbing layer 60 and each separated portion 22 of the supporting plate 20. To be specific, an air layer is formed therebetween.

Fixation Structure of Heat-resistant Floor

Figure 2:
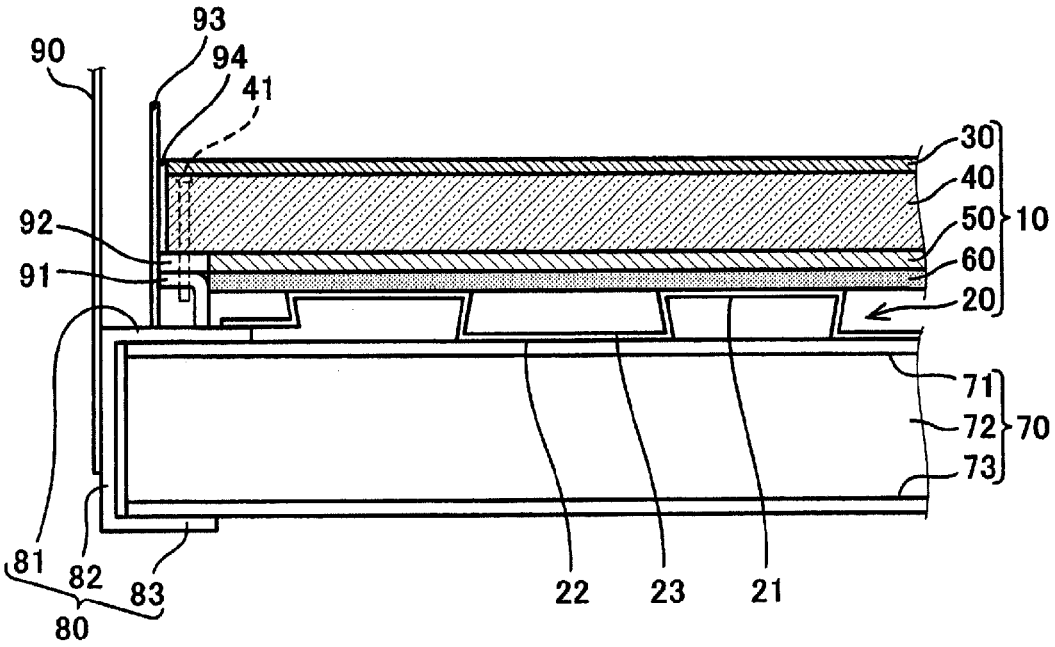
FIG. 2 is an enlarged cross-sectional view of the heat-resistant floor according to Embodiment 1 of the present invention.
Figure 3:
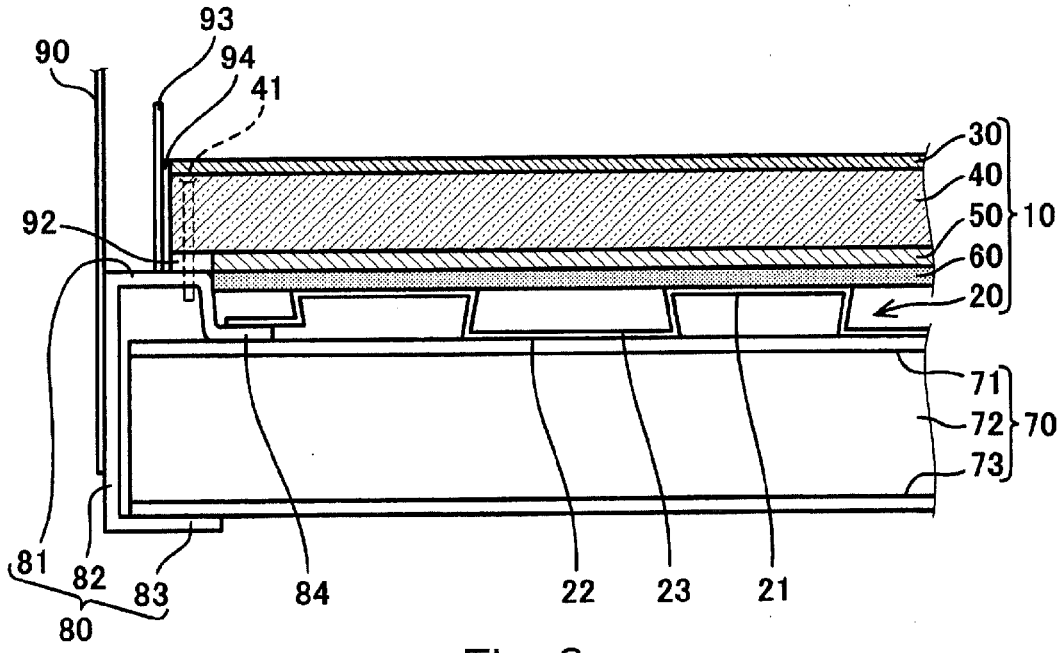
FIG. 3 is a diagram showing Modification Example of Embodiment 1 of the present invention.

Next, a fixation structure of the heat-resistant floor 10 according to the present embodiment will be explained in reference to FIGS. 2 and 3. FIG. 2 is an enlarged cross-sectional view showing an end portion of the heat-resistant floor 10 according to the present embodiment. As described above, the heat-resistant floor 10 is supported by the cross beam 70 and fixed to the side sill 80.

The cross beam 70 and the side sill 80 will be simply explained. The cross beam 70 extends in the width direction and constitutes a part of a bodyshell (a portion responsible for the strength of a carbody) of the railcar 100. The cross beam 70 is mainly constituted by: a horizontal plate-shaped upper surface portion 71 contacting the heat-resistant floor 10; a vertical plate-shaped side surface portion 72 coupled to the upper surface portion 71; and a horizontal plate-shaped lower surface portion 73 coupled to the side surface portion 72 and opposed to the upper surface portion 71. The side sill 80 extends in the longitudinal direction and constitutes a part of the bodyshell of the railcar 100. The side sill 80 is mainly constituted by: a horizontal plate-shaped upper surface portion 81 located at an upper side; a vertical plate-shaped side surface portion 82 coupled to the upper surface portion 81; and a horizontal plate-shaped lower surface portion 83 coupled to the side surface portion 82 and opposed to the upper surface portion 81. The side sill 80 opens inwardly in the width direction, and an end portion of the cross beam 70 is inserted into the side sill 80. In the present embodiment, the upper surface portion 81 of the side sill 80 is formed to be wider than the lower surface portion 83 of the side sill 80. The side sill 80 and the cross beam 70 are fixed to each other by, for example, welding. A side bodyshell 90 of the railcar 100 is fixed to an outer side of the side surface portion 82 of the side sill 80.

The present embodiment is not configured in such a manner that: the heat-resistant floor 10 is formed in advance; and then the entire heat-resistant floor 10 is fixed to the side sill 80. To be specific, in the present embodiment, respective components of the heat-resistant floor 10 are stacked on and fixed to the cross beam 70 and the side sill 80 in order from the supporting plate 20. Thus, the entire heat-resistant floor 10 is finally fixed to the side sill 80. First, a substantially end portion (a left end side in FIG. 2) of the supporting plate 20 is being directly fixed to the side sill 80. Specifically, the substantially end portion of the supporting plate 20 is formed in a flat plate shape and is located above a bottom surface portion 23 of the separated portion 22 by a thickness of the side sill 80. The substantially end portion of the supporting plate 20 is fixed to the side sill 80 by, for example, welding.

The heat dispersing layer 50 and the heat absorbing layer 60 are fixed so as to be sandwiched between the supporting plate 20 and the floor panel 40. End edges of the heat dispersing layer 50 and the heat absorbing layer 60 extend to a stage member 91 or a liner 92. The stage member 91 is a member having an L-shaped cross section and fixed to the upper surface portion 81 of the side sill 80 and a dividing member 93 so as to become a bridge between the upper surface portion 81 and the dividing member 93. The liner 92 is a rod-shaped member extending in the longitudinal direction and is mounted on the stage member 91. Further, the thickness of the liner 92 is set such that an upper surface of the liner 92 and an upper surface of the heat dispersing layer 50 are flush with each other.

An end portion of the floor panel 40 is mounted on the liner 92. A through hole is formed at the end portion of the floor panel 40. Further, a through hole is also formed at the liner 92 so as to correspond to the through hole of the floor panel 40, and a threaded hole is formed at the stage member 91 so as to correspond to the through hole of the floor panel 40. The screw 41 is inserted through the through holes of the floor panel 40 and the liner 92 to be screwed into the threaded hole of the stage member 91. With this, the floor panel 40 is fixed to the stage member 91 (side sill 80).

Finally, the surface sheet 30 is provided over the upper surface of the floor panel 40 so as to cover the screw 41. In the present embodiment, the dividing member 93 is provided outside the heat-resistant floor 10 in the width direction. The dividing member 93 is a vertical plate-shaped member. The dividing member 93 is fixed to the upper surface portion 81 of the side sill 80 and extends in the longitudinal direction. A sealing member 94 is inserted between the dividing member 93 and the floor panel 40 and between the dividing member 93 and the surface sheet 30. With this, the floor panel 40 and the surface sheet 30 are prevented from moving in the width direction.

The foregoing has explained the fixation structure of the heat-resistant floor 10. The foregoing has explained a case where the floor panel 40 and the supporting plate 20 are fixed to each other by the screw 41. However, the present embodiment is not limited to this. The heat-resistant floor 10 may be fixed by joining respective layers with an adhesive, a double-sided tape, or the like.

Modification Example

In the present embodiment, the heat-resistant floor 10 is fixed by the configuration shown in FIG. 2. Instead of this, the heat-resistant floor 10 may be fixed by the configuration shown in FIG. 3. FIG. 3 is a diagram showing Modification Example of the configuration shown in FIG. 2. As shown in FIG. 3, in Modification Example, a vertical size (height) of the cross beam 70 is smaller than that in FIG. 2. In addition, a step portion 84 located lower than the other portion of the upper surface portion 81 of the side sill 80 is formed at the upper surface portion 81 so as to contact the upper surface portion 71 of the cross beam 70. As is clear from the comparison between FIGS. 2 and 3, a portion of the upper surface portion 81 other than the step portion 84 serves as the stage member 91 of FIG. 2. Therefore, the stage member 91 is not provided in Modification Example. To be specific, in Modification Example shown in FIG. 3, an installation position of the heat-resistant floor 10 is lower than that in FIG. 2 by a height-direction size of the stage member 91. According to Modification Example including the above configuration, since the installation position of the heat-resistant floor 10 is lowered, a large inner space of the railcar 100 can be secured.

Figure 4:
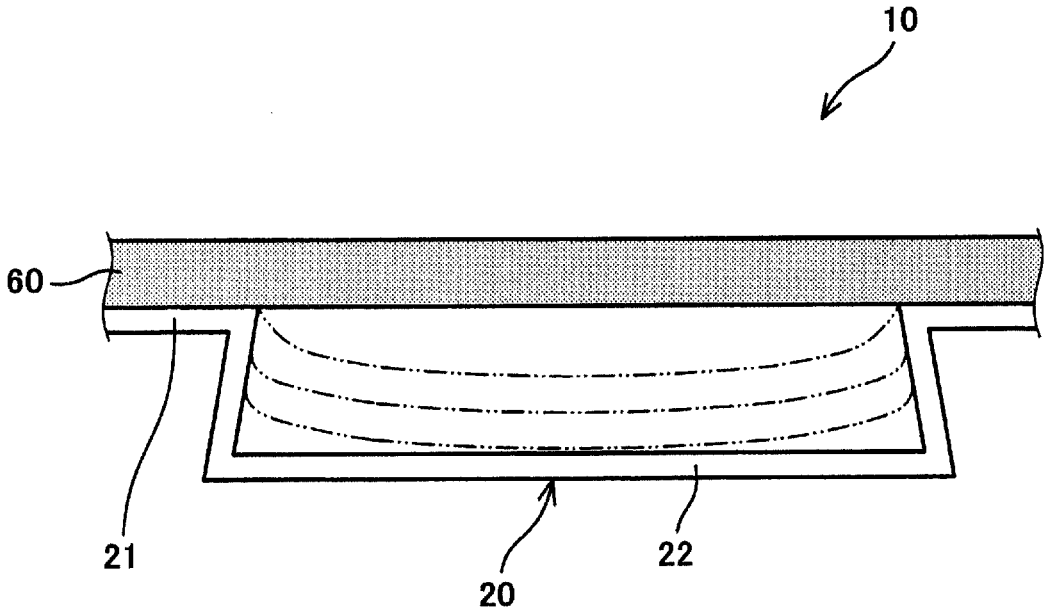
FIG. 4 is a diagram showing the state of the expansion of a heat absorbing layer according to Embodiment 1 of the present invention.

Actions of Heat-resistant Floor Next, actions when heat is applied to the lower surface of the heat-resistant floor 10 according to the present embodiment will be explained in reference to FIG. 4. FIG. 4 is a diagram showing the state of the expansion of the heat absorbing layer 60 according to the present embodiment. When heat is gradually applied to the lower surface of the heat-resistant floor 10, the entire supporting plate 20 increases in temperature substantially uniformly. Then, the heat is transferred from the supporting plate 20 to the heat absorbing layer 60, and the heat absorbing layer 60 increases in temperature. At this time, in the heat absorbing layer 60, the portions contacting the contacting portions 21 of the support plate 20 increase in temperature more quickly than the portions spaced above the separated portions 22. This is because as described above, the air layer exists between the heat absorbing layer 60 and each separated portion 22, and the heat is less likely to transfer to the heat absorbing portion spaced from the separated portions 22 of the supporting plate 20 as compared to the contacting portions 21. Therefore, the portions, contacting the supporting plate 20, of the heat absorbing layer 60 absorb heat at first to expand, and the portions not contacting the supporting plate 20 absorb heat later to expand.

As above, according to the heat-resistant floor 10 of the present embodiment, the entire heat absorbing layer 60 does not start absorbing heat at the same time, but there is a difference in a heat absorption start time among respective portions of the heat absorbing layer 60. Therefore, a period of time in which the heat absorbing layer 60 absorbs heat as a whole can be increased, and the rate of the temperature increase can be lowered. Further, as shown by a chain double-dashed line in FIG. 4, the expanded portions of the heat absorbing layer 60 gradually spread in spaces each between the original heat absorbing layer 60 and each separated portion 22 and then serve as the heat insulating layer. Therefore, even after the heat absorption, the heat absorbing layer 60 prevents the heat from being transferred to the upper surface side of the heat-resistant floor 10, and therefore, is useful to continuously suppress the increase in temperature of the upper surface side of the heat-resistant floor 10. In the present embodiment, in a cross-sectional view, the separated portion 22 is formed so as to increase in width as it extends downward. Therefore, as compared to a case where the separated portion 22 is formed so as not to increase in width as it extends downward, a large space between the heat absorbing layer 60 and each separated portion 22 can be secured. With this, the expanded heat absorbing layer 60 after the heat absorption can be adequately housed in the spaces.

The supporting plate 20 serves as a fire wall with respect to flame under the floor and also serves as a part of the bodyshell of the railcar 100. Therefore, according to the present embodiment, it is unnecessary to add a new component as the fire wall, and it is also unnecessary to add a reinforcing member for securing the stiffness. On this account, the present embodiment can realize a simple configuration of the railcar and a reduction in weight of the railcar while realizing the adequate heat resistance and strength of the railcar.

In a case where the heat absorbing layer 60 expands to serve as the heat insulating layer, the portions corresponding to the contacting portion 21 of the supporting plate 20 and the portions corresponding to the separated portion 22 of the supporting plate 20 are significantly different in thickness from each other. Therefore, the heat insulating effect of the heat absorbing layer 60 differs depending on respective portions thereof. However, since the heat dispersing layer 50 located at the upper surface side of the heat absorbing layer 60 can disperse heat in the surface direction (horizontal direction), nonuniform heat transferred from the heat absorbing layer 60 to the heat dispersing layer 50 is uniformized in the surface direction. By the uniformization of the heat by the heat dispersing layer 50, the heat resistance of the heat-resistant floor 10 can be further improved.

Embodiment 2

Figure 5:
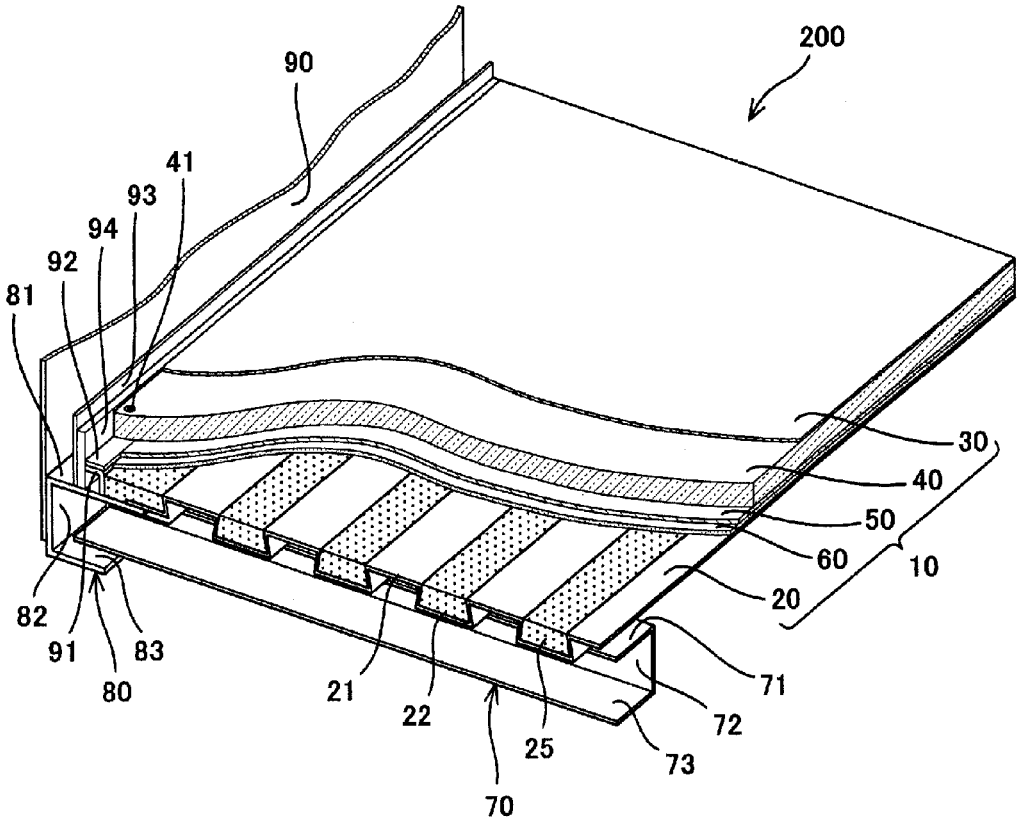
FIG. 5 is a cross-sectional perspective view of the heat-resistant floor according to Embodiment 2 of the present invention.

Next, a railcar 200 according to Embodiment 2 of the present invention will be explained in reference to FIG. 5. The railcar 200 according to the present embodiment is different in configuration from the railcar 100 according to Embodiment 1 in that each of heat insulating materials 25 is inserted between the heat absorbing layer 60 and each separated portion 22. Except for this, the railcar 200 according to the present embodiment and the railcar 100 according to Embodiment 1 are basically the same in configuration as each other. The heat insulating material 25 inserted between the heat absorbing layer 60 and the separated portion 22 is not especially limited. For example, ceramic wool or glass wool may be used as the heat insulating material 25. It is desirable that the heat insulating material 25 be a material that can easily deform and is extremely soft. This allows the heat absorbing layer 60, when heated, to expand into the space between the heat absorbing layer 60 and the separated portion 22, as the heat insulating material 25 does not present an obstacle with respect to the expansion of the heat absorbing layer 60.

According to the heat-resistant floor 10 of the present embodiment, since the heat insulating material 25 is inserted between the heat absorbing layer 60 and the separated portion 22 as above, the rate of the heat transfer from the separated portion 22 to the heat absorbing layer 60 can be reduced. As a result, the temperature increase at the portions not contacting the supporting plate 20 can be further slowed down. Therefore, as compared to the heat-resistant floor 10 according to Embodiment 1, a period of time in which the heat absorbing layer 60 absorbs heat further increases, so that the rate of the temperature increase on the upper surface of the heat-resistant floor 10 can be further slowed down.

The foregoing has explained Embodiments 1 and 2 of the present invention in reference to the drawings. However, a specific configuration of the present invention is not limited to these embodiments. Design modifications and the like within the spirit of the present invention are included in the present invention. For example, the foregoing has explained a case where the separated portion 22 is formed in a groove shape. However, a configuration in which each separated portion 22 projects downward to have a semispherical shape is included in the present invention.

In addition, the foregoing has explained a case where the heat absorbing layer 60 expands by heat. However, a configuration in which the heat absorbing layer 60 does not expand by heat by using as the heat absorbing material a material that is less likely to expand or by reducing the amount of heat absorbing material is included in the present invention.

INDUSTRIAL APPLICABILITY

According to the railcar including the heat-resistant floor according to the present invention, the heat absorbing layer of the heat-resistant floor can continuously absorb heat for a long period of time, so that the heat resistance can be improved. Therefore, the present invention is useful in a technical field of the railcar including the heat-resistant floor.

REFERENCE SIGNS LIST

10 heat-resistant floor
20 supporting plate
21 contacting portion
22 separated portion
25 heat insulating material
50 heat dispersing layer
60 heat absorbing layer
100, 200 railcar

The invention claimed is:

1. A railcar comprising:

a cross beam extending in a railcar width direction; and a heat-resistant floor supported by the cross beam, wherein:

the heat-resistant floor includes a floor panel, a heat absorbing layer provided under the floor panel and configured to absorb heat, and a supporting plate located above the cross beam and configured to support the heat absorbing layer from below; and the supporting plate includes contacting portions each configured to contact the heat absorbing layer, and separated portions each continuously formed from the contacting portion in the railcar width direction, separated downward from the heat absorbing layer so as not to contact the heat absorbing layer, and extending in a railcar longitudinal direction.

2. The railcar according to claim 1, wherein the supporting plate is a corrugated plate in which the contacting portions and the separated portions are alternately, continuously provided in the railcar width direction.

3. The railcar according to claim 1, wherein an air layer is provided between the heat absorbing layer and each of the separated portions.

4. The railcar according to claim 1, wherein a heat insulating material is provided between the heat absorbing layer and each of the separated portions.

5. The railcar according to claim 1, wherein the heat absorbing layer expands when absorbing the heat.

6. The railcar according to claim 1, wherein the heat-resistant floor further includes a heat dispersing layer provided between the floor panel and the heat absorbing layer and configured to disperse the heat in a surface direction.

7. The railcar according to claim 1, wherein the heat absorbing layer starts absorbing the heat at a temperature of 350 to 550° C.

8. The railcar according to claim 1, further comprising a side sill extending in the railcar longitudinal direction, an end portion of the cross beam being inserted into the side sill, wherein:

the side sill opens inwardly in the railcar width direction and includes an upper surface portion located at an upper side, a side surface portion coupled to the upper surface portion, and a lower surface portion coupled to the side surface portion and opposed to the upper surface portion;

the upper surface portion of the side sill includes a step portion located lower than the other portion of the upper surface portion of the side sill such that the step portion contacts an upper surface of the cross beam; and a lower surface of the separated portion located at an end portion of the supporting plate in the railcar width direction contacts an upper surface of the step portion.

9. The railcar according to claim 1, further comprising a side sill extending in the railcar longitudinal direction, an end portion of the cross beam being inserted into the side sill, wherein:

the side sill opens inwardly in the railcar width direction and includes an upper surface portion located at an upper side, a side surface portion coupled to the upper surface portion, and a lower surface portion coupled to the side surface portion and opposed to the upper surface portion;

the upper surface portion of the side sill includes a step portion located lower than the other portion of the upper surface portion of the side sill such that the step portion contacts an upper surface of the cross beam; and the upper surfaces of the contacting portions of the supporting plate are located lower than an upper surface of the upper surface portion of the side sill.

* * * * *